United States Patent [19]

Arai et al.

[11] Patent Number: 4,522,169

[45] Date of Patent: Jun. 11, 1985

[54] VARIABLE CYLINDER DEVICE FOR INTERNAL COMBUSTION ENGINES

[75] Inventors: Fuminao Arai, Chiryu; Yoshio Okabe, Kariya, both of Japan

[73] Assignee: Aisin Seiki Kabushiki Kaisha, Kariya, Japan

[21] Appl. No.: 535,259

[22] Filed: Sep. 23, 1983

[30] Foreign Application Priority Data

Sep. 29, 1982 [JP] Japan ..... 57-170669
Sep. 29, 1982 [JP] Japan ..... 57-147790[U]
Sep. 29, 1982 [JP] Japan ..... 57-147792[U]

[51] Int. Cl.[3] ..... F01L 1/24; F02D 13/06

[52] U.S. Cl. ..... 123/198 F; 123/90.16; 123/90.43

[58] Field of Search ..... 123/90.16, 90.39, 90.43, 123/198 F

[56] References Cited

U.S. PATENT DOCUMENTS 2,871,838 2/1959 Dadd ..... 123/90.43
4,114,588 9/1978 Jordan ..... 123/90.43
4,213,442 7/1980 Mihalic ..... 123/90.43 X

FOREIGN PATENT DOCUMENTS 98608 7/1980 Japan ..... 123/90.43
2075118 11/1981 United Kingdom ..... 90.16/

*Primary Examiner*—William R. Cline
*Assistant Examiner*—Peggy A. Neils
*Attorney, Agent, or Firm*—Oblon, Fisher, Spivak, McClelland and Maier

[57] ABSTRACT

A variable cylinder device for internal combustion engines having a movable rocker arm and a movable rocker shaft in which an oil-supplying type lash adjuster is fitted to a housing having a main oil-passage and the rocker shaft is secured to a rocker support. Oil for lubricating the sliding surface of movable rocker shaft is supplied from the main oil-passage through a series of passages formed in the housing and the rocker support, especially through a pipe protruding from the rocker support and slidably inserted into the housing. The housing is further provided with a mechanism for reducing the oil-pressure in the main oil-passage and a mechanism for preventing rotation of the rocker support.

5 Claims, 3 Drawing Figures

VARIABLE CYLINDER DEVICE FOR INTERNAL COMBUSTION ENGINES

BACKGROUND OF THE INVENTION

1. Field of the Invention

This invention relates to a variable cylinder devices for internal combustion engines in general, and more particularly to a variable cylinder device including a valve lift mechanism to which a lash adjuster of oil-supplying type is fitted.

2. Prior Art of the Invention

In recent years, variable cylinder devices for internal combustion engines employing various methods for the saving of energy and the reduction of fuel consumption have been made available. The applicant of the present invention proposed in U.S. patent application Ser. No. 482,445 (now U.S. Pat. No. 4,462,353), filed in 1983, a new variable cylinder device for internal combustion engine which has a valve lift mechanism to which a lash adjuster of an oil-supplying type is fitted. In this variable cylinder device, however, whose rocker arm is movable, there was a fear of lubrication being made difficult owing to the movableness of a rocker arm. Also, in this variable cylinder device with a movable rocker arm, there was a fear that proper operation of a variable cylinder would become difficult since oil could not escape and a rocker support and a body could not follow the operation of a solenoid valve, in the case where the system does not have a relief-valve.

Further, in a rocker support with a movable rocker arm, only its upper part is fixed to the lower part of a lash adjuster, but no other parts are supported. A body of a lash adjuster fixed to a rocker support is cylindrical and merely inserted in a hollow portion of an adjuster support so that the body can slide up and down. For this reason, there was a fear that the rocker support should rotate around the body and that a rocker arm secured to the rocker support should move away from the upper end of a valve of a valve lift mechanism and from a cam surface.

SUMMARY OF THE INVENTION

It is an object of the present invention to provide a variable cylinder device including an oil-supplying mechanism to a rocker arm whereby oil lubrication to the rocker arm can be securely attained, even though the rocker arm is of a movable type.

It is another object of the present invention to provide a variable cylinder device including an oil-pressure control unit which enables proper operation of a variable cylinder having a movable rocker arm.

It is still another object of the present invention to provide a variable cylinder device including an antirotation mechanism which comprises a mechanism to prevent rotation of a rocker support.

According to the present invention, a lash adjuster of an oil-supplying type is attached to a housing which has a main passage for supplying oil to a reservoir of a lash adjuster, passages thereof communicating to said reservoir through a central hole of an adjuster support in which a valve stem penetrates and a longitudinal hole communicating to said passages. The rocker support has a passage leading to a central hole of a pipe which is inserted in said longitudinal hole of the housing and integrated with said rocker support and a longitudinal passage connected to said passage through the outer surface of the lower part of said lash adjuster. The rocker shaft has a passage leading to said longitudinal passage of the rocker support, a central hole connected to said passage and a passage communicating to said central hole and to the sliding surface of said rocker arm.

When the engine load becomes small, a lash adjuster stops the valve lifting operation and a solenoid valve is activated by the signals of a microcomputer so that the valve stem is shifted downward and the check valve is opened. When a cam rotates under this condition, the rocker arm does not rock around the rocker shaft, but carries out an up-and-down rocking movement with a junction between the upper part of the valve and the rocker arm as its pivot. On the other hand, a pipe, inserted in a longitudinal hole of the housing and integrated with a rocker support which moves up and down with a rocker arm, moves up and down in this condition. Consequently, said longitudinal hole leading to the main passage of oil and the central hole of a rocker shaft leading to the sliding surface of a rocker arm are connected through a passage of rocker support and the central hole of said pipe.

Accordingly, even the case of a rocker arm being movable, the supply of lubricating oil to the sliding surface of the rocker arm is assured since the oil passage in the housing and the oil passage in the rocker support are always connected through the longitudinal hole of the housing and the pipe of the rocker support. As a result, the problem of lubrication can be completely solved even in case of a movable rocker arm.

According to another aspect of the invention, at the midpoint of a main passage which feeds oil to the reservoir in said lash adjuster, said housing has a hole connected to said main passage, and to said hole is linked an oil-escape mechanism having a plunger which makes the oil inside said main passage escape when the oil pressure in said main passage increases. When a rocker arm rocks up and down around the upper end of the valve by the rotation of a cam, and the rocker support and body of the lash adjuster also move up and down at the same time, the oil inside the reservoir flows in and out of the main passage. At this time, the oil pressure in the main passage is increased by the oil which has flowed into the main passage from the reservoir and a plunger of the oil-escape mechanism is pressed and shifted by this pressurized oil so that the oil in the main passage can escape into said escape mechanism. For this reason, the body follows the up-and-down rocking movement of a rocker arm even in the high-speed region, resulting in proper operation of a variable cylinder. The structure of a variable cylinder can be simplified as compared with other types of variable cylinders, because only a relief valve or accumulator is incorporated into the housing.

According to still another aspect of the invention, one or more vertical end faces are formed on the side of a rocker support to which the lower part of the body of said lash adjuster is fitted, and at least one of said vertical end faces is arranged so as to face with a slight clearance the rib or wall provided in said housing.

By these arrangements, even if a rocker support starts to rotate around the body of a lash adjuster, the vertical end face formed on the side of the rocker support comes in contact with the rib or wall of the housing. Consequently, rotation of the rocker support and removal of the rocker arm secured to said rocker support from the upper end of the valve or cam surface can be prevented.

Further, effects such as smooth movement of a rocker support and the reduction of wear in a moving-valve system can be achieved.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF PREFERRED EMBODIMENTS

Figure 1:
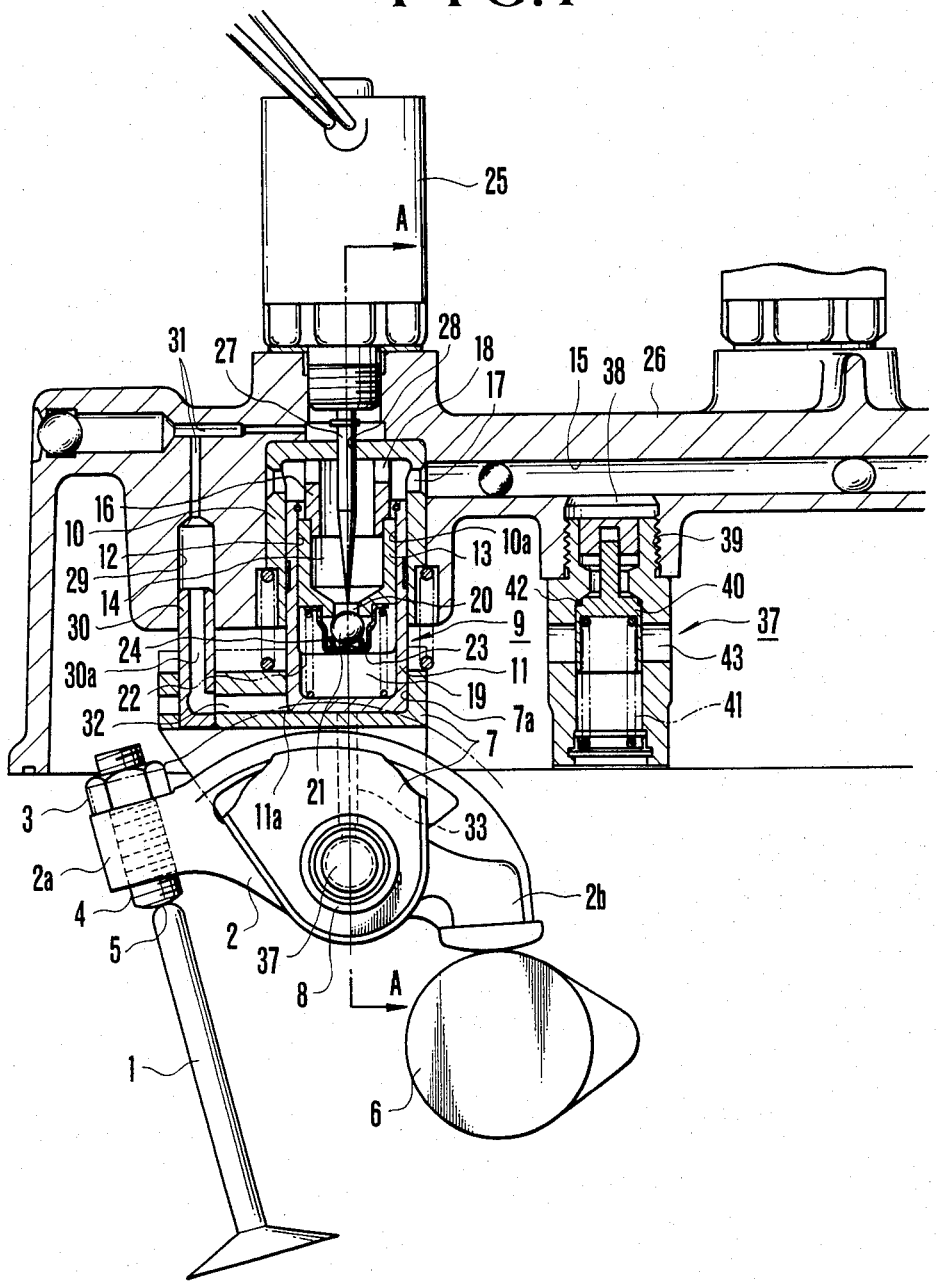
FIG. 1 is a longitudinal sectional view of an example of a movable variable cylinder device according to the present invention.
Figure 2:
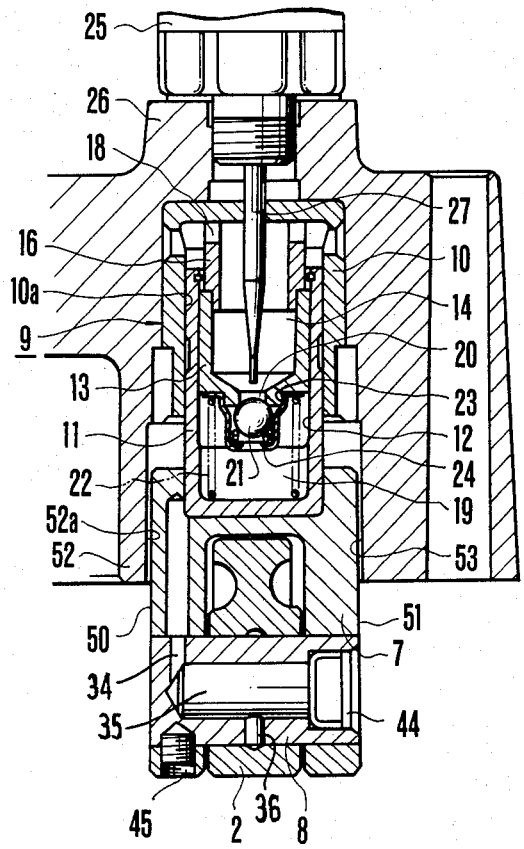
FIG. 2 is a sectional view taken along line A—A of FIG. 1.

In FIGS. 1 and 2, a valve (1) is utilized to control opening and closing of a passage between a combustion chamber (not shown) and a cylinder head port. Said valve (1) is biased so as to be continuously closed by a spring (not shown) and its upper end (5) is brought in contact with an adjuster screw (4) fixed to an end (2*a*) of a rocker arm (2) by a nut (3).

The other end (2*b*) of a rocker arm (2) is in contact with a cam surface of a cam (6). The rocker arm (2) is also capable of rocking around the core of a rocker shaft (8) as its pivot point which is fixed to a rocker support (7) and supports rocker arm (2) and rocker support (7). When the cam rotates, the rocker arm (2) carries out a rocking movement, and the valve (1) repeats opening and closing operation through an adjuster screw (4).

The lower part of the body (11) of the known lash adjuster of an oil-supplying type is press-fitted into the hollow portion of the rocker support (7). The upper part of the body (11) of the lash adjuster (9) is inserted in a slidable manner in the hollow portion (10*a*) of the adjuster support (10) fixed to the housing (26). The body, constituting a cylinder (12) whose upper end is open, carries out a reciprocating up-and-down movement. A plunger (13) provided inside the cylinder is in static condition.

Inside the plunger (13) is formed a reservoir (14), in which oil is supplied through a main passage (15) from oil pump (not shown), a passage (17) in the adjuster support (10) and a passage (18) in a plunger support (16).

Also, inside the body (11), a pressure chamber (19) is formed below the plunger (13). A ball check valve (21) which opens and closes an oil passage (20) is provided on the pressure chamber (19) side of the oil passage (20) formed at the center of the bottom part of the plunger (13). This check valve (21) permits the flow of oil from the reservoir (14) to the pressure chamber (19), but prevents a reverse flow of the oil from the pressure chamber (19) to the reservoir (14). The check valve (21) is biased towards the closed direction by a spring (24) whose one end is supported by a retainer (23) held by a spring (22).

A solenoid valve fixed to a housing (26) is fitted to the upper section of the adjuster support (10). This solenoid valve is activated by a microcomputer (not shown). The microcomputer senses the input signals from the engine such as, for example, the speed of the vehicle, the degree of throttle opening and the temperature of the engine, to regulate and activate the valve. From the solenoid valve (25) a valve stem (27) penetrates downwards through a central hole (28) in the upper surface of the adjuster support (10) and is inserted in the reservoir (14) in a slidable manner in an up-and-down direction.

In the housing (26) is formed a longitudinal hole (29) and a pipe (30) secured to the rocker support (7) is inserted so as to slide up and down. Also, an oil passage (31) connecting to the longitudinal hole (29) is provided inside the housing (26) and said passage (31) is connected to the main passage (15) formed in the aforementioned housing (26) through the clearance between the central hole (28) and the valve stem (27) and the passages (18), (17). Further, the hole (30*a*) of the pipe (30) linked to the longitudinal hole (29) is connected to a central hole (35) of the rocker shaft (8) through a horizontal passage (32) formed in the rocker support (7), chamfered part (11*a*) of the bottom of the body (11), a longitudinal passage (33) in the rocker support (7) and a passage (34) formed in the rocker shaft (8) so that the oil is supplied to the sliding surface of the rocker arm (2) via said central hole (35) and a passage (36). Numeral (44) indicates a member which covers the opening of the central hole (35) of the rocker shaft (8) and (45) is a setscrew which fixes the rocker shaft (8) to the rocker support (7).

A relief valve (37) is linked to a hole (38) leading to the main passage (15) by means of a screw (39). When the oil pressure in the main passage (15) increases, a plunger (40) of the relief valve (37) is pressed downwards in opposition to a spring (41), sealing by O-ring (42) becomes ineffective, the oil in the main passage (15) escapes and relief is available through a hole (43).

In the device of the above-mentioned embodiment, the lash adjuster (9) ordinarily carries out the known operation by repeating an expanding-contracting movement of a small order. However, when the engine load is small, the microcomputer will sense, for example, engine input signals such as engine load, vehicle speed and the degree of throttle opening, to activate the solenoid valve (25). In response to the operation of said valve (25), the valve stem (27) moves downwards, presses the check valve (21) down and opens the oil passage (20). Since this enables the two chambers consisting of the pressure chamber (19) and the reservoir (14) to be connected to each other, the oil in the pressure chamber (19) will shift into the reservoir (14). When the cam rotates in this condition, the rocker arm (2), carrying out a rocking movement around the center of the rocker shaft (8) as its pivot in ordinary operation, will come to rock around the upper end (5) of the valve (1) as its pivot point, so that the valve (1) will not perform opening and closing operation.

On the other hand, the oil in the main passage (15) moves into the reservoir (14) via passages (17) and (18), reaches the passage (31) through the clearance between the central hole (28) of the adjuster support (10) and the valve stem (27), arrives further at the longitudinal passage (33) through the longitudinal hole (29), the central hole (30*a*), horizontal passage (32) and chamfered part (11*a*) of the bottom of the body (11), flows into the central hole (35) of the rocker shaft (8) via the passage (34), and lubricates the sliding surface of the rocker arm (2) via the passage (36).

When the rocker arm (2) rocks around the upper end (5) of the valve (1) as its pivot point, the rocker support (7) and the body (11) also carries out an up-and-down movement. Consequently, during the rise the oil in the reservoir (14) and pressure chamber (19) is sent into the main passage (15) resulting in an increase of the pressure in said passage (15). Thus, when the oil pressure in the passage (15) builds up, the pressurized oil presses the plunger (40) downwards via the hole (38) in opposition to the spring (41) and relieve the oil in the passage (15).

Figure 3:
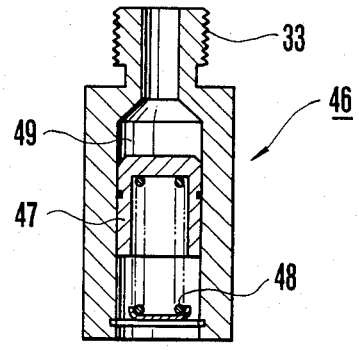
FIG. 3 is a longitudinal sectional view of an example of an oil damper which can be mounted instead of the relief valve mechanism shown in FIG. 1.

FIG. 3 shows an accumulator (46) in another embodiment of the present invention which can be mounted instead of the relief valve (37) shown in FIG. 1. A plunger (47) of this accumulator is pressed down by the pressurized oil in opposition to a spring (48) and expands the volume of a reservoir (49) so as to temporarily store the oil in the main passage (15) here. There is no difference in the operation effects between this embodiment and the aforementioned embodiment.

In the above-mentioned embodiment, in case of the body (11) being cylindrical, the rocker support (7) rotates around the body (11) as its center and accompanies the rotation of the rocker arm (2) secured to the rocker support. Accordingly there is a fear of both ends (2*a*) and (2*b*) of the rocker arm (2) not coming into contact with the valve (1) and cam (6).

For this reason, the utilization of an antirotation structure of the rocker support (7) becomes necessary. In the above mentioned embodiment, as is shown in FIG. 2, the section of the rocker support (7) is made to be of a square form and the end faces (50), (51) are arranged to provide a slight clearance in relation to the face (52*a*) of the rib (52) and the wall (53). Consequently, if the rocker support starts to rotate around the body (11) as its center, the end faces (50) and (51) bump against the rib face (52*a*) and the wall (53), which prevents the rotation of the rocker support (7) and rocker arm (2) and removal of the rocker arm (2) from the upper end of the cam (6) and valve (1). If at least one square face of the rocker support (7) bumps against the rib face or wall of the housing, a sufficient antirotational effect is obtained. Accordingly the structure is not restricted to the one shown in the drawing in which two end faces bump at the same time and the section of the rocker support (7) is not limited to be of a square form.

What is claimed is:

1. A variable cylinder device for an internal combustion engine, comprising:

a valve lift mechanism having a rocker arm which rocks around a rocker shaft and causes an intake or exhaust valve to operate in response to a rotary movement of a camshaft;

an oil-supplying type lash adjuster fixed to a housing at its upper portion and fitted to a rocker support at its lower end portion, said rocker shaft being fixed to said rocker support;

a mechanism for shifting the rocking fulcrum of said rocker arm so that the rocker arm rocks around its one end which is in contact with the upper end of a valve stem of said intake or exhaust valve, causing said rocker support to be movable up-and-down with the rocker shaft, thereby maintaining a closed position of said intake or exhaust valve;

said rocker support having a pipe protruding upwards and slidably inserted into a longitudinal hole formed in said housing and a lubrication oil passage which connects said pipe with a sliding surface between said rocking shaft and said rocker arm;

said housing having a main oil passage for supplying oil to said lash adjuster and a lubrication oil passage which connects said main oil passage with said longitudinal hole in the housing; and said sliding surface between the rocking shaft and the rocker arm being supplied with lubrication oil from said main oil passage through said lubrication oil passage in said housing, said pipe protruding from the rocker support and said lubrication oil passage in said rocker support.

2. A variable cylinder device for an internal combustion engine of claim 1, wherein the mechanism for shifting the rocking fulcrum of the rocker arm further comprises:

a solenoid valve fitted to the upper end portion of the lash adjuster and actuated by signals from said engine; and a stem movable up-and-down and protruding from said solenoid valve into the lash adjuster, said stem pushing a check valve positioned between an oil reservoir and a pressure chamber in the lash adjuster to open an oil passage when said solenoid valve is actuated, thereby causing an adjuster body in the lash adjuster to be movable up-and-down.

3. A variable cylinder device for an internal combustion engine of claim 1, wherein the lubrication oil passage formed in the rocker support further comprises a longitudinal passage which connects a central hole of the rocker shaft with an outer bottom surface of the lash adjuster, and a horizontal hole which connects said outer bottom surface of the lash adjuster with said pipe.

4. A variable cylinder device for an internal combustion engine of claim 1, wherein the housing has a mechanism for reducing the oil pressure in the main oil passage, fixed to a hole of the housing leading to the main oil passage on the way to the lash adjuster so as to cause oil in the main oil passage to flow into said mechanism when the oil pressure in the main passage increases.

5. A variable cylinder device for an internal combustion engine of claim 1, wherein the rocker support has at least one vertical flat surface, and the housing has at least one rib or wall extending downwards and facing said flat surface of rocker support with a slight clearance so as to prevent the rotation of rocker support.

* * * * *